US007611034B1

(12) United States Patent
Peterson

(10) Patent No.: US 7,611,034 B1
(45) Date of Patent: Nov. 3, 2009

(54) TIE HANGER SYSTEM

(76) Inventor: Cristen R. Peterson, 101 Poinciana La., Largo, FL (US) 33770

( * ) Notice: Subject to any disclaimer, the term of this patent is extended or adjusted under 35 U.S.C. 154(b) by 385 days.

(21) Appl. No.: 11/809,382

(22) Filed: Jun. 1, 2007

(51) Int. Cl.
*A41D 27/22* (2006.01)

(52) U.S. Cl. ..... 223/88; 223/DIG. 1; 211/115; 211/116; 211/119

(58) Field of Classification Search ..... 223/85, 223/88, 95, DIG. 1; D6/315, 317; 211/115, 211/116, 119
See application file for complete search history.

(56) References Cited

U.S. PATENT DOCUMENTS

| | | | | | |
|---|---|---|---|---|---|
| 2,748,953 | A | * | 6/1956 | Behlefeldt | 211/113 |
| 2,760,648 | A | * | 8/1956 | Van Dusen | 211/118 |
| 2,777,582 | A | * | 1/1957 | Van Dusen | 211/119 |
| D179,907 | S | * | 3/1957 | Kruger | D6/315 |
| D201,112 | S | * | 5/1965 | Stein | D6/315 |
| D206,638 | S | * | 1/1967 | Van Dusen | D6/315 |
| 3,342,345 | A | * | 9/1967 | Van Dusen | 211/119 |
| 3,370,715 | A | * | 2/1968 | Kolozsvari | 211/116 |
| 3,951,270 | A | * | 4/1976 | Kiss | 211/119 |
| 4,366,909 | A | * | 1/1983 | Fahmi | 211/116 |
| 4,428,486 | A | | 1/1984 | Collins | |
| 4,429,797 | A | * | 2/1984 | Collins | 211/119 |
| 4,811,852 | A | | 3/1989 | Kelly | |
| 4,858,772 | A | | 8/1989 | Phillipson | |
| 5,613,628 | A | | 3/1997 | Burkhalter | |
| 5,881,931 | A | * | 3/1999 | Stanfield | 223/85 |
| D428,711 | S | * | 8/2000 | Rowley | D6/317 |
| 6,769,555 | B2 | | 8/2004 | Brady | |
| D506,076 | S | * | 6/2005 | Weisgerber | D6/317 |
| D526,131 | S | * | 8/2006 | McGowan | D6/317 |

* cited by examiner

*Primary Examiner*—Gary L Welch
*Assistant Examiner*—Nathan E Durham
(74) *Attorney, Agent, or Firm*—Edward P. Dutkiewicz

(57) ABSTRACT

A main frame is formed front and rear components. Each component has a pair of vertically oriented exterior legs and interior legs. A pair of upper connectors have horizontal central and end sections. The end sections are coupled to the upper ends of the exterior legs. Pairs of lower connectors are coupled between the lower ends of the exterior and interior legs. The lower connectors are at an angle to support ties. Upper and lower spacers join the exterior in a major rectilinear configuration. The upper and lower spacers join the interior legs in a minor rectilinear configuration. A generally semicircular finger extends upwardly and outwardly away from the interior legs to receive belts. A swivel assembly includes a hook at the upper end. The swivel assembly includes a vertical leg. The vertical leg is rotatably coupled to the central sections of the upper connectors.

7 Claims, 7 Drawing Sheets

FIG 3
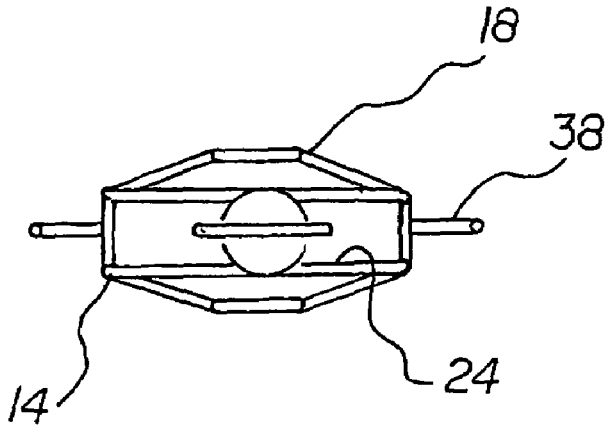
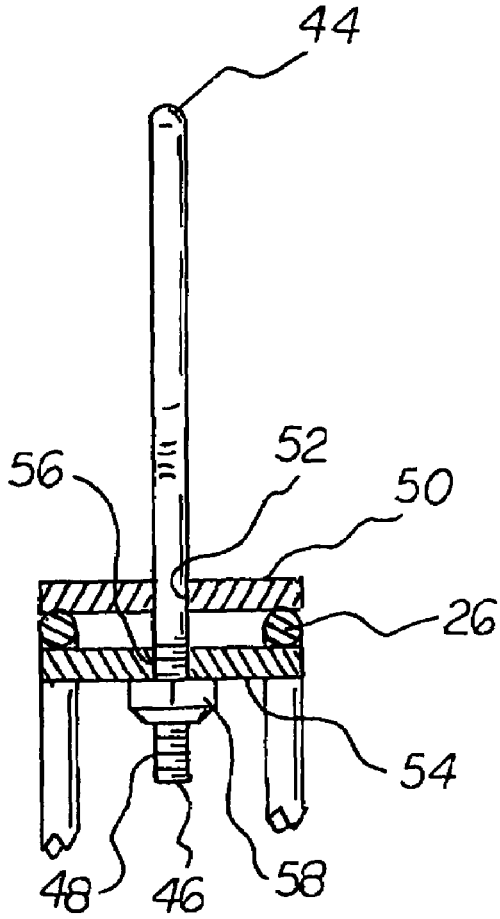
FIG 4

FIG 9
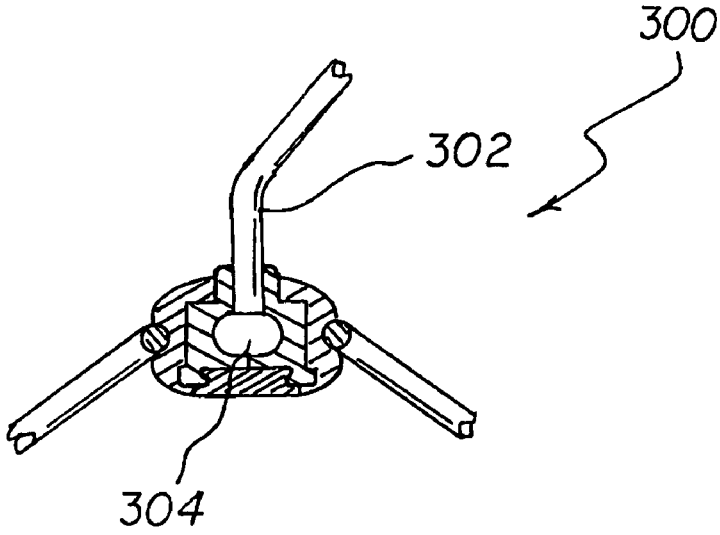
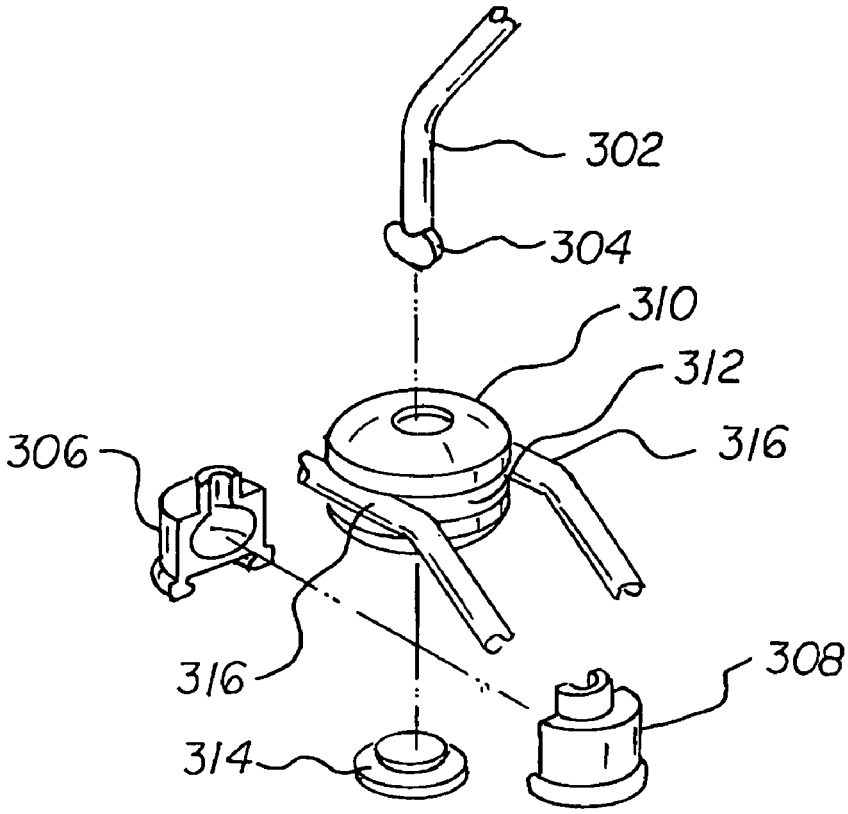
FIG 10

FIG 13
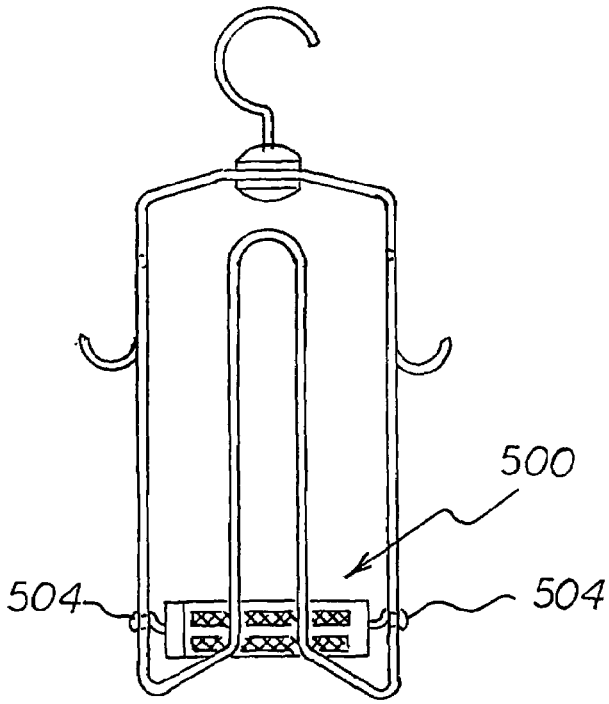
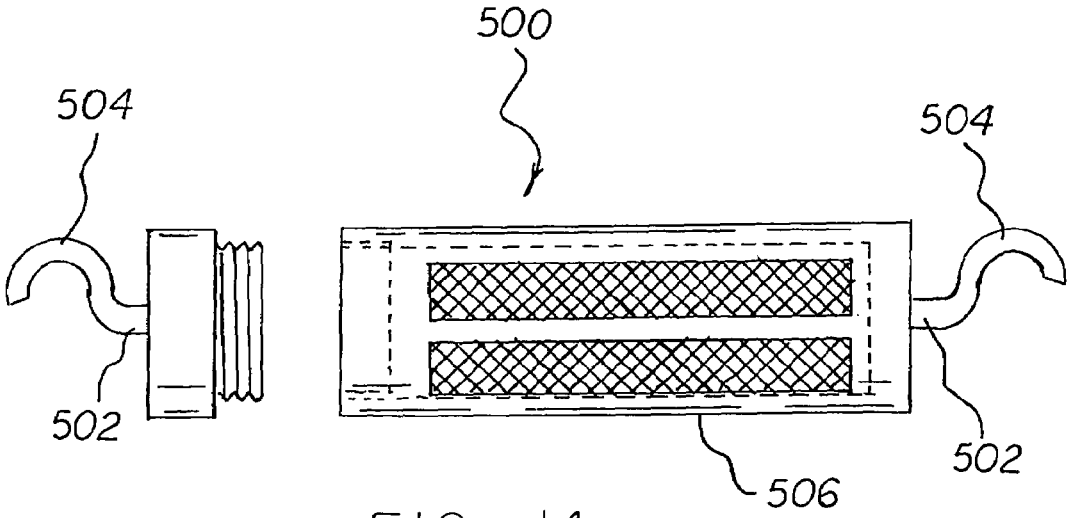
FIG 14

TIE HANGER SYSTEM

BACKGROUND OF THE INVENTION

1. Field of the Invention

The present invention relates to a tie hanger system and more particularly pertains to supporting ties and belts and like apparel accessories in a readily retrievable, space conserving and cost effective manner.

2. Description of the Prior Art

The use of hanging systems of known designs and configurations is known in the prior art. More specifically, hanging systems of known designs and configurations previously devised and utilized for the purpose of hanging accessories through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,769,555 issued Aug. 3, 2004 to Brady relates to a Clothing Accessory Hanging Apparatus. U.S. Pat. No. 5,613,628 issued Mar. 25, 1997 to Burkhalter relates to a Garment Hanger Device. U.S. Pat. No. 4,858,772 issued Aug. 22, 1989 to Phillipson relates to a Carousel Accessory Unit. U.S. Pat. No. 4,811,852 issued Mar. 12, 1989 to Kelly relates to a Apparel Holder. Lastly, U.S. Pat. No. 4,428,486 issued Jan. 31, 1984 to Collins relates to a Self Balancing Belt-Caddy.

While these devices fulfill their respective, particular objectives and requirements, the aforementioned patents do not describe a tie hanger system that allows for supporting ties and belts and like apparel accessories in a readily retrievable, space conserving and cost effective manner.

In this respect, the tie hanger system according to the present invention substantially departs from the conventional concepts and designs of the prior art, and in doing so provides an apparatus primarily developed for the purpose of supporting ties and belts and like apparel accessories in a readily retrievable, space conserving and cost effective manner.

Therefore, it can be appreciated that there exists a continuing need for a new and improved tie hanger system which can be used for supporting ties and belts and like apparel accessories in a readily retrievable, space conserving and cost effective manner. In this regard, the present invention substantially fulfills this need.

SUMMARY OF THE INVENTION

In view of the foregoing disadvantages inherent in the known types of hanging systems of known designs and configurations now present in the prior art, the present invention provides an improved tie hanger system. As such, the general purpose of the present invention, which will be described subsequently in greater detail, is to provide a new and improved tie hanger system and method which has all the advantages of the prior art and none of the disadvantages.

To attain this, the present invention essentially comprises a tie hanger system. First provided is a main frame. The main frame has a front component. The main frame has a similarly configured rear component. Each component has a pair of vertically oriented widely spaced exterior legs. The exterior legs have upper and lower ends. Each component has a pair of vertically oriented narrowly spaced interior legs. The interior legs have upper and lower ends. Each component has a pair of upper connectors. Each upper connector has a horizontal central section. Each upper connector has downwardly angled end sections. The end sections are coupled with respect to the upper ends of the exterior legs. Each component has a front pair of lower connectors. Each component has a rear pair of lower connectors. The front pair of lower connectors are coupled between the lower ends of the exterior legs and the lower ends of the interior legs of the front component. The rear pair of lower connectors are coupled between the lower ends of the exterior legs and the lower ends of the interior legs of the rear component. The lower connectors are at an angle. The interior legs are higher than the exterior legs. The space between the front and back components is wider at the interior legs than at the exterior legs. The front pair of lower connectors is adapted to support ties. The rear pair of lower connectors is adapted to support ties and scarfs and like apparel accessories.

Upper spacers and lower spacers are provided. The upper and lower spacers are of equal length. The upper and lower spacers join the exterior legs of the front and rear components in a major rectilinear configuration. The upper and lower spacers further join the interior legs of the front and rear components in a minor rectilinear configuration. Each lower spacer is located in proximity to the lower connectors. Each upper spacer is located in proximity to the upper connectors. A generally semicircular finger is provided. The finger extends upwardly and outwardly away from the interior legs. In this manner belts and suspenders and like apparel accessories are received.

Provided last is a swivel assembly. The swivel assembly includes a hook. The hook is provided at the upper end of the swivel assembly. The swivel assembly includes a vertical leg. The vertical leg has male threads. The vertical leg is provided at the lower end of the swivel assembly. The swivel assembly also includes an upper washer. The upper washer has an aperture. The swivel assembly includes a lower washer. The lower washer has an aperture. The apertures receive the vertical leg. The central sections of the upper connectors are secured between the washers. The swivel assembly includes a nut. The nut is threadedly received on the threads of the vertical leg. In this manner the front and rear sections are secured with respect to the swivel assembly. Further in this manner the system is suspended from the hook.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tie hanger system which has all of the advantages of the prior art hanging systems of known designs and configurations and none of the disadvantages.

It is another object of the present invention to provide a new and improved tie hanger system which may be easily and efficiently manufactured and marketed.

It is further object of the present invention to provide a new and improved tie hanger system which is of durable and reliable constructions.

An even further object of the present invention is to provide a new and improved tie hanger system which is susceptible of a low cost of manufacture with regard to both materials and labor, and which accordingly is then susceptible of low prices of sale to the consuming public, thereby making such tie hanger system economically available to the buying public.

Even still another object of the present invention is to provide a tie hanger system for supporting ties and belts and like apparel accessories in a readily retrievable, space conserving and cost effective manner.

Lastly, it is an object of the present invention to provide a new and improved tie hanger system. A main frame is formed front and rear components. Each component has a pair of vertically oriented exterior legs and interior legs. A pair of upper connectors have horizontal central and end sections. The end sections are coupled to the upper ends of the exterior legs. Pairs of lower connectors are coupled between the lower ends of the exterior and interior legs. The lower connectors are at an angle to support ties. Upper and lower spacers join the exterior in a major rectilinear configuration. The upper and lower spacers join the interior legs in a minor rectilinear configuration. A generally semicircular finger extends upwardly and outwardly away from the interior legs to receive belts. A swivel assembly includes a hook at the upper end. The swivel assembly includes a vertical leg. The vertical leg is rotatably coupled to the central sections of the upper connectors.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view of the system taken along line 3-3 of FIG. 1.

FIG. 4 is a cross sectional view taken along line 4-4 of FIG. 1.

FIG. 9 is a cross sectional view taken along line 9-9 of FIG. 8.

FIG. 10 is a perspective illustration of the swivel shown in FIGS. 7-9.

FIG. 13 is a front elevational view of an aroma generator adapted for use in any of the prior embodiments.

FIG. 14 is an enlarged exploded illustration of the aroma generator shown in FIG. 13.

The same reference numerals refer to the same parts throughout the various Figures.

DESCRIPTION OF THE PREFERRED EMBODIMENT

Figure 1:
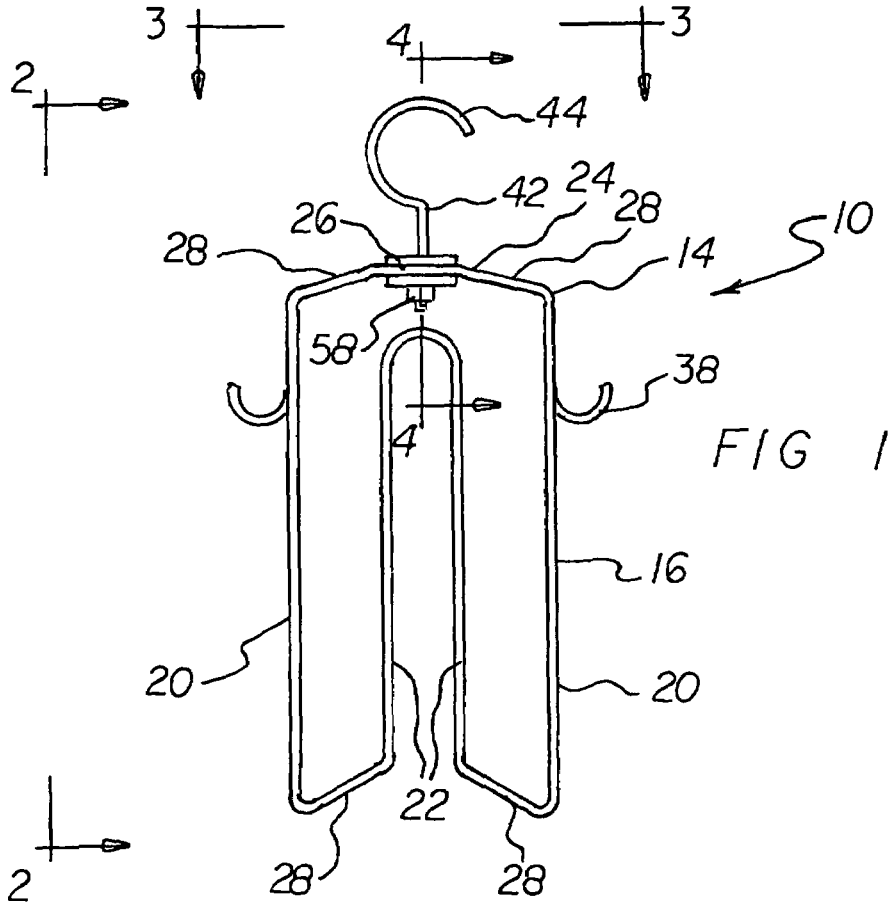
FIG. 1 is front elevational view of a tie hanger system constructed in accordance with the principles of the present invention.
Figure 2:
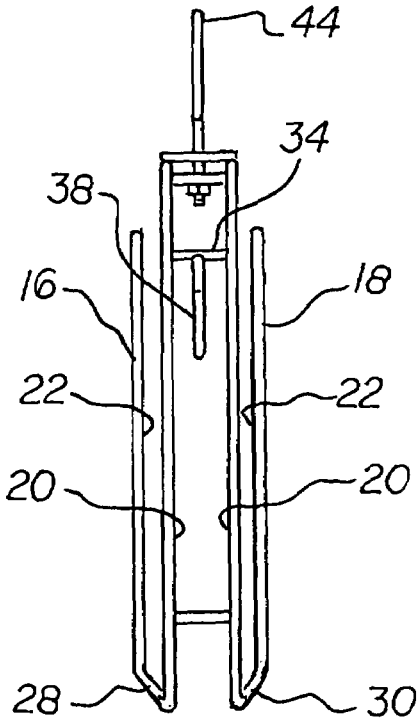
FIG. 2 is a side elevational view of the tie hanger system taken along line 2-2 of FIG. 1.
Figure 5:
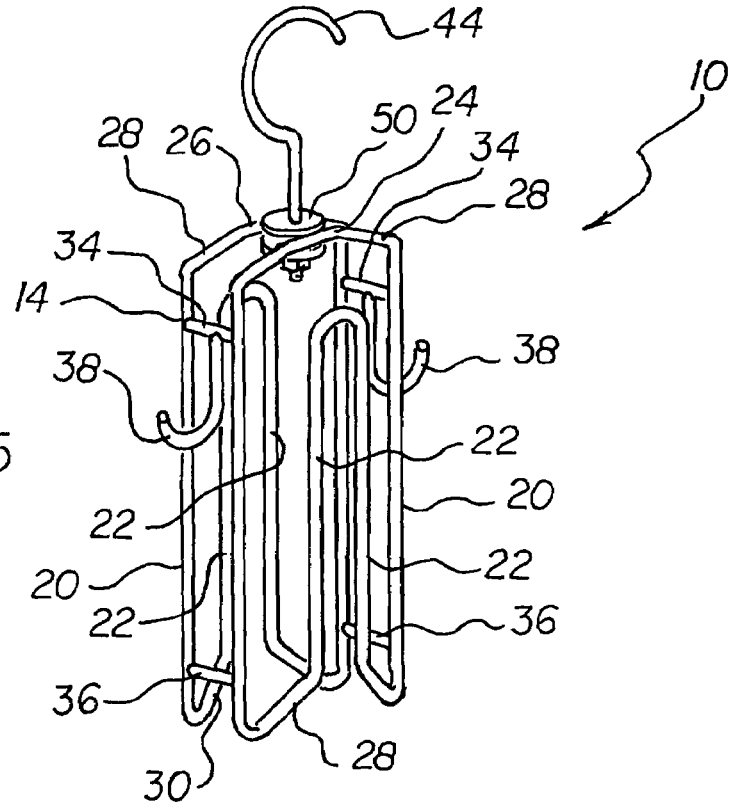
FIG. 5 is a perspective illustration of the embodiment shown in FIGS. 1-4.

With reference now to the drawings, and in particular to FIG. 1 thereof, the preferred embodiment of the new and improved tie hanger system embodying the principles and concepts of the present invention and generally designated by the reference numeral 10 will be described.

The present invention, the tie hanger system 10 is comprised of a plurality of components. Such components in their broadest context include a main frame, upper and lower spacers and a swivel assembly. Such components are individually configured and correlated with respect to each other so as to attain the desired objective.

First provided is a main frame 14. The main frame has a front component 16. The main frame has a similarly configured rear component 18. Each component has a pair of vertically oriented widely spaced exterior legs 20. The exterior legs have upper and lower ends. Each component has a pair of vertically oriented narrowly spaced interior legs 22. The interior legs have upper and lower ends. Each component has a pair of upper connectors 24. Each upper connector has a horizontal central section 26. Each upper connector has downwardly angled end sections 28. The end sections are coupled with respect to the upper ends of the exterior legs. Each component has a front pair of lower connectors 28. Each component has a rear pair of lower connectors 30. The front pair of lower connectors are coupled between the lower ends of the exterior legs and the lower ends of the interior legs of the front component. The rear pair of lower connectors are coupled between the lower ends of the exterior legs and the lower ends of the interior legs of the rear component. The lower connectors are at an angle. The interior legs are higher than the exterior legs. The space between the front and back components is wider at the interior legs than at the exterior legs. The front pair of lower connectors is adapted to support ties. The rear pair of lower connectors is adapted to support ties and scarfs and like apparel accessories.

Upper spacers 34 and lower spacers 36 are provided. The upper and lower spacers are of equal length. The upper and lower spacers join the exterior legs of the front and rear components in a major rectilinear configuration. The upper and lower spacers further join the interior legs of the front and rear components in a minor rectilinear configuration. Each lower spacer is located in proximity to the lower connectors. Each upper spacer is located in proximity to the upper connectors. A generally semicircular finger 38 is provided. The finger extends upwardly and outwardly away from the interior legs. In this manner belts and suspenders and like apparel accessories are received.

Provided last is a swivel assembly 42. The swivel assembly includes a hook 44. The hook is provided at the upper end of the swivel assembly. The swivel assembly includes a vertical leg 46. The vertical leg has male threads 48. The vertical leg is provided at the lower end of the swivel assembly. The swivel assembly also includes an upper washer 50. The upper washer has an aperture 52. The swivel assembly includes a lower washer 54. The lower washer has an aperture 56. The apertures receive the vertical leg. The central sections of the upper connectors are secured between the washers. The swivel assembly includes a nut 58. The nut is threadedly received on the threads of the vertical leg. In this manner the front and rear sections are secured with respect to the swivel assembly. Further in this manner the system is suspended from the hook.

Figure 6:
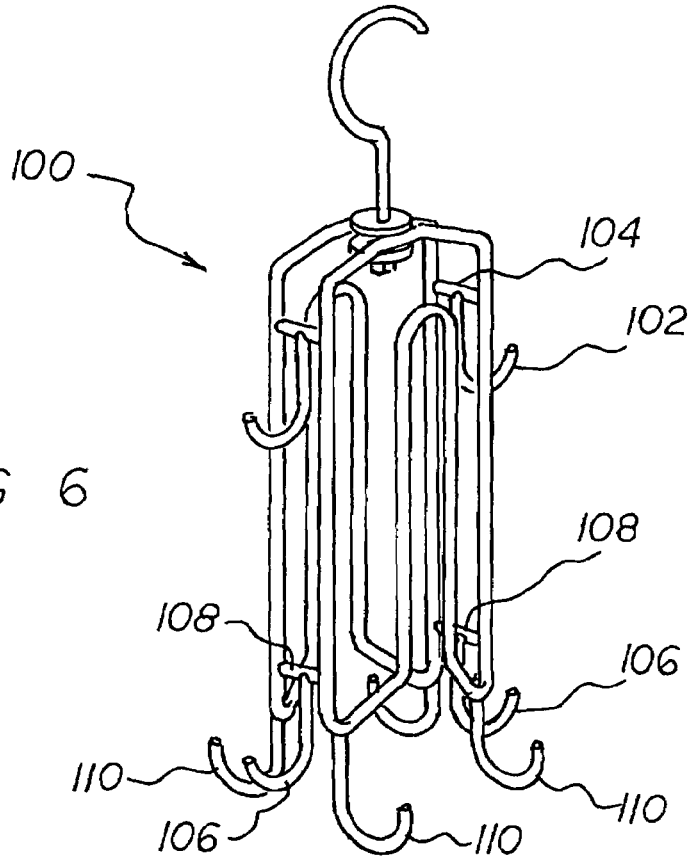
FIG. 6 is a perspective illustration of another embodiment of the invention.

In the embodiment shown in FIG. 6, the system 100 includes upper fingers 102. The upper fingers are provided in a common central plane. A supporting upper spacer and lower fingers 106 are provided. The supporting upper spacer and lower fingers are provided in a common central plane. A supporting lower spacer 108 is provided. Further provided are four supplemental fingers 110. The supplemental fingers depend from the exterior legs in planes perpendicular to the common central plane.

Figure 7:
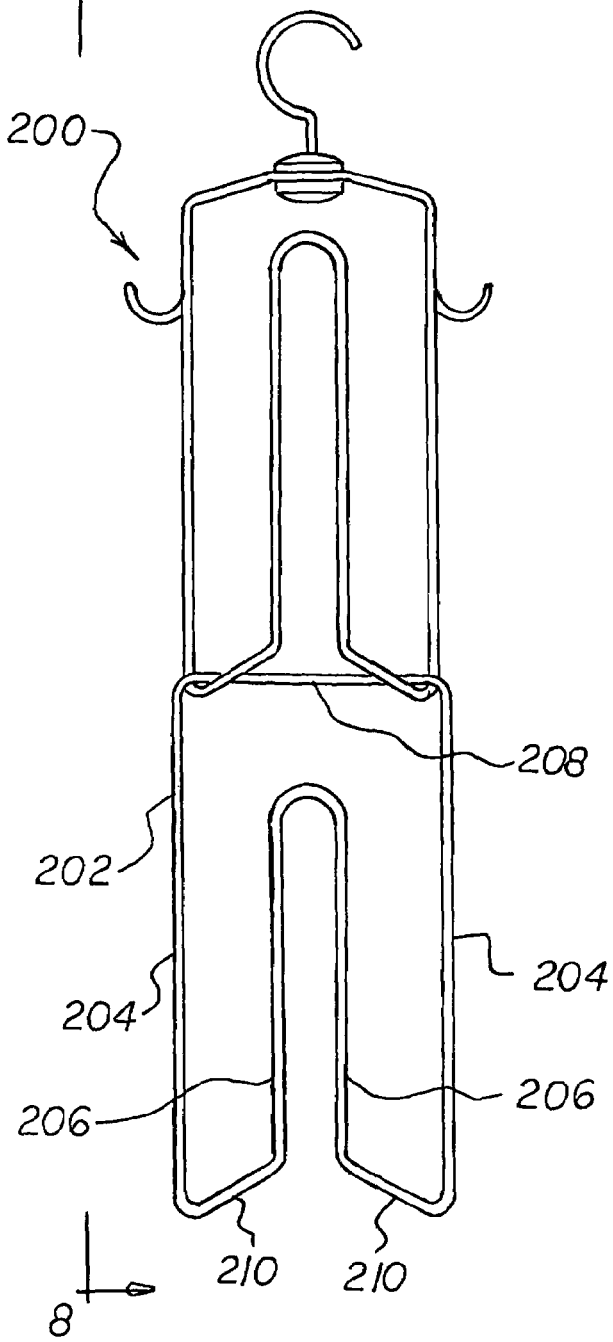
FIG. 7 is a front elevational view of an alternate embodiment of the invention.
Figure 8:
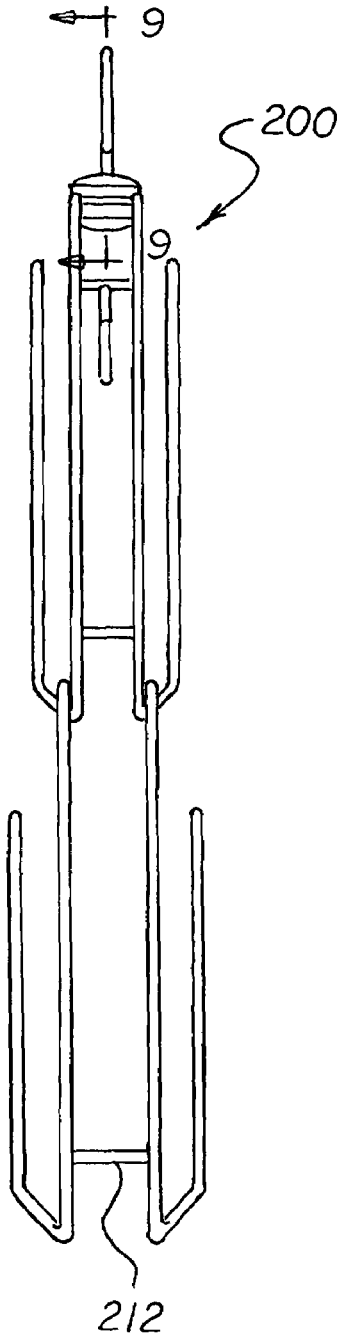
FIG. 8 is a side elevational view taken along line 8-8 of FIG. 7.
Figure 11:
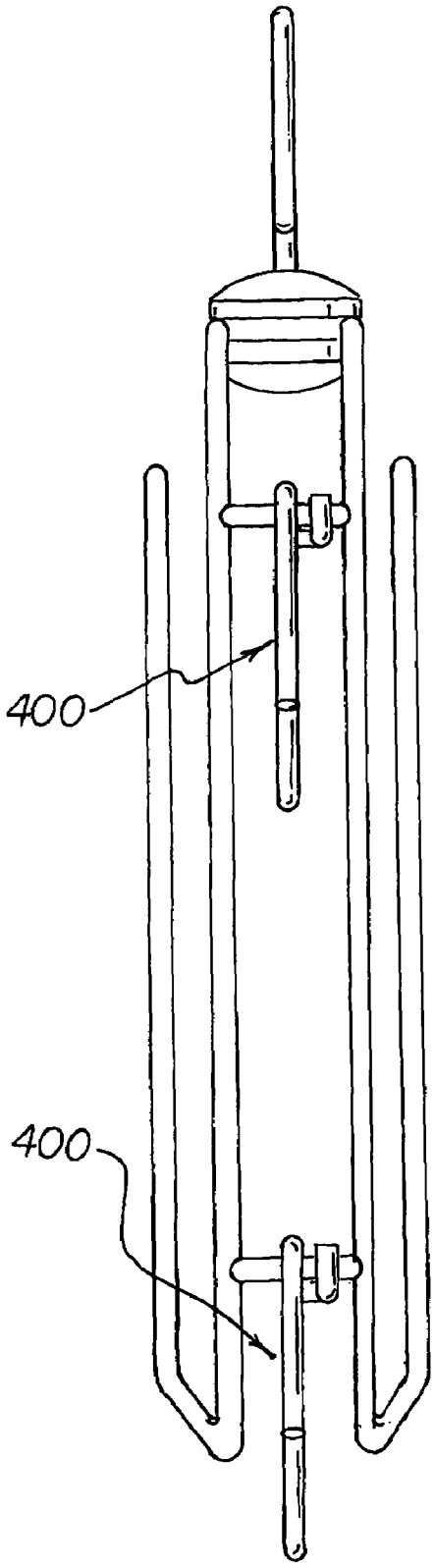
FIG. 11 is a side elevational view of an alternate finger construction adapted for use in any of the prior embodiments.
Figure 12:
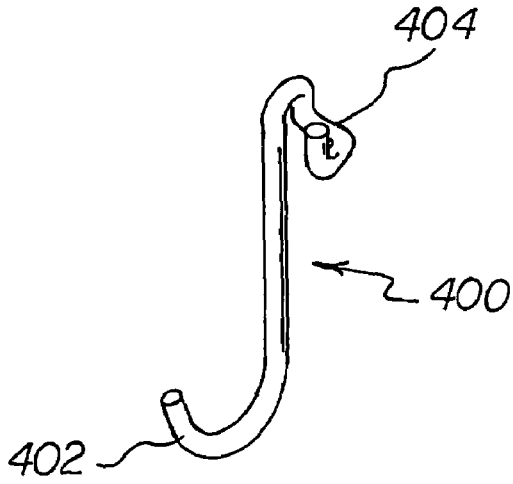
FIG. 12 is a perspective illustration of the finger shown in FIG. 11.

The alternate embodiment of FIGS. 7 and 8 is a system 200 which includes a supplemental frame 202. The supplemental frame has a pair of vertically oriented exterior legs 204. The supplemental frame has interior legs 206. The supplemental frame also has a pair of upper connectors 208. Each upper connector has a horizontal central section. The central section connects the upper ends of the exterior legs of each component. In this manner the upper ends may be received on the lower connectors of the main frame. Pairs of lower connectors 210 are provided. The lower connectors are coupled between the lower ends of the exterior and interior legs. The lower connectors are provided at an angle to support ties.

The alternate embodiment of the present invention shown in FIGS. 9 and 10 is a system 300 wherein a vertical leg 302 is provided. The vertical leg has a protuberance 304. The protuberance is provided at the lower end of the vertical leg. A two piece minor housing 306, 308 is provided. The minor housing rotatably receives the protuberance. An enlarged apertured major housing 310 is provided. The major housing receives the minor housing. The major housing has an annular recess 312. The major housing has a lower stopper 314. The lower stopper retains the minor housing within the major housing. The main frame has central sections 316. The annular recess receives the central sections of the main frame. This feature is adapted for use in any of the prior embodiments.

Another alternate embodiment of the present invention there is a system 400 with fingers which have lower sections 402. The lower sections are provided in a semicircular configuration. The fingers have upper sections 404. The upper sections are provided in a generally cork-screw configuration. In this manner the upper sections may be removably retained on the main frame. This minor housing is adapted for use in any of the prior embodiments.

In this final alternate embodiment of the present invention, the system 500 includes an aroma generator. The aroma generator has a horizontal support 502. The horizontal support terminates in end hooks 504. The end hooks are adapted to be supported on interior legs of the main frame. A central apertured chamber 506 is provided. The central chamber is adapted to receive an aroma generating substance. One end cap is adapted to be threadedly supported by the cylindrical central chamber for receiving the aroma generating substance while at least a portion of the side wall of the chamber has apertures to allow the aroma to move from interior of, to exterior of, the chamber. This aroma generator is adapted for use in any of the prior embodiments.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hanger system comprising:

a main frame formed of a front and rear component with each having a pair of vertically oriented exterior legs and interior legs, a pair of upper connectors with each having a horizontal central section and end sections coupled with respect to the upper ends of the exterior legs, pairs of lower connectors coupled between the lower ends of the exterior and interior legs, the lower connectors being at an angle to support ties;

upper and lower spacers joining the exterior legs in a major rectilinear configuration and the interior legs in a minor rectilinear configuration with a generally semicircular finger extending upwardly and outwardly away from the interior legs for receiving belts; and a swivel assembly including a hook at the upper end and a vertical leg rotatably coupled to the central sections of the upper connectors.

2. The system as set forth in claim 1 wherein the fingers include upper fingers in a common central plane with a supporting upper spacer and lower fingers in a common central plane with a supporting lower spacer and further including four supplemental fingers depending from the exterior legs in planes perpendicular to the common central plane.

3. The system as set forth in claim 1 and further including a supplemental frame having a pair of vertically oriented exterior legs and interior legs, a pair of upper connectors with each having a horizontal central section connecting the upper ends of the exterior legs of each component for being received on the lower connectors of the main frame, pairs of lower connectors coupled between the lower ends of the exterior and interior legs, the lower connectors being at an angle to support ties.

4. The system as set forth in claim 1 wherein the vertical leg includes a protuberance at its lower end with a two piece minor housing rotatably receiving the protuberance and with an enlarged apertured major housing receiving the minor housing, the major housing including an annular recess and a lower stopper for retaining the minor housing within the major housing, the annular recess receiving the central sections of the main frame.

5. The system as set forth in claim 1 wherein the fingers have lower sections in a semicircular configuration and upper sections in a generally cork-screw configuration for being removably retained on the main frame.

6. The system as set forth in claim 1 and further including an aroma generator with a horizontal support terminating in end hooks adapted to be supported on interior legs of the main frame with a central apertured chamber adapted to receive an aroma generating substance.

7. A tie hanger system for supporting ties and belts and like apparel accessories in a readily retrievable, space conserving and cost effective manner comprising, in combination:

a main frame formed of a front component and a similarly configured rear component, each component having a pair of vertically oriented widely spaced exterior legs with upper and lower ends and a pair of vertically oriented narrowly spaced interior legs with upper and lower ends, a pair of upper connectors with each upper connector having a horizontal central section and downwardly angled end sections coupled with respect to the upper ends of the exterior legs, a front pair of lower connectors and a rear pair of lower connectors with the front pair of lower connectors coupled between the lower ends of the exterior legs and the lower ends of the interior legs of the front component and with the rear pair of lower connectors coupled between the lower ends of the exterior legs and the lower ends of the interior legs of the rear component, the lower connectors being at an angle with the interior legs higher than the exterior legs, the space between the front and back components being wider at the interior legs than at the exterior legs, the front pair of lower connectors adapted to support ties and a rear pair of lower connectors adapted to support ties and scarfs and like apparel accessories;

upper spacers and lower spacers of equal length joining the exterior legs of the front and rear components in a major rectilinear configuration and joining the interior legs of the front and rear components in a minor rectilinear configuration, each lower spacer being located in proximity to the lower connectors and each upper spacer being located in proximity to the upper connectors with a generally semicircular finger extending upwardly and outwardly away from the interior legs for receiving belts and suspenders and like apparel accessories; and a swivel assembly including a hook at the upper end and a vertical leg with male threads at the lower end, the swivel assembly also including an upper washer with an aperture and a lower washer with an aperture, the apertures receiving the vertical leg with the central sections of the upper connectors secured between the washers and a nut threadedly received on the threads of the vertical leg to secure the front and rear sections with respect to the swivel assembly for suspending the system from the hook.

* * * * *